US006884160B1

(12) United States Patent
Sundholm

(10) Patent No.: US 6,884,160 B1
(45) Date of Patent: Apr. 26, 2005

(54) BARRIER APPARATUS FOR RESISTING PASSAGE OF HARMFUL GASES THROUGH AN OPENING

(75) Inventor: Goran Sundholm, Tuusula (FI)

(73) Assignee: Marioff Corporation Oy, Vantaa (FI)

( * ) Notice: Subject to any disclaimer, the term of this patent is extended or adjusted under 35 U.S.C. 154(b) by 0 days.

(21) Appl. No.: 09/958,238

(22) PCT Filed: Apr. 7, 2000

(86) PCT No.: PCT/FI00/00298

§ 371 (c)(1),
(2), (4) Date: Jun. 7, 2002

(87) PCT Pub. No.: WO00/59579

PCT Pub. Date: Oct. 12, 2000

(30) Foreign Application Priority Data

Apr. 7, 1999 (FI) ..... 990766

(51) Int. Cl.[7] ..... F24F 9/00
(52) U.S. Cl. ..... 454/191; 169/9; 169/48
(58) Field of Search ..... 169/43, 48, 51, 169/9, 91; 454/188, 191, 57

(56) References Cited

U.S. PATENT DOCUMENTS

| | | | | |
|---|---|---|---|---|
| 4,121,790 A | * | 10/1978 | Graham | 244/118.5 |
| 4,315,456 A | * | 2/1982 | Hayashi et al. | 454/191 |
| 4,986,364 A | | 1/1991 | Clark | 169/48 |
| 5,167,572 A | * | 12/1992 | Etkin | 454/57 |
| 5,353,879 A | | 10/1994 | Watanabe et al. | 169/52 |
| 6,702,299 B1 | | 3/2004 | Yamaguchi et al. | 454/342 |

FOREIGN PATENT DOCUMENTS

| | | | |
|---|---|---|---|
| DE | 19825420 | | 12/1999 |
| FR | 2089320 | | 1/1972 |
| JP | 4-16252 | * | 1/1992 |
| JP | 10-165625 | * | 6/1998 |
| WO | 93/10861 | | 6/1993 |
| WO | 97/39801 | | 10/1997 |

* cited by examiner

*Primary Examiner*—Harold Joyce
(74) *Attorney, Agent, or Firm*—Ladas & Parry LLP

(57) ABSTRACT

The invention relates to a barrier apparatus for resisting passage of harmful gases from a space through a substantially vertical opening having a top, a bottom and lateral sides, the barrier apparatus comprising a suction arrangement for sucking gases and blowing arrangement for creating a flow of a medium. In order to effectively process harmful gases even in large spaces, the suction arrangement comprises at least one suction port (1) located near the top of the opening to provide blowing substantially along the width of the opening, the blowing arrangement comprises at least one blowing port (5) located near the bottom of the opening to provide blowing substantially along the width of the opening, a fluid coupling (8, 9) coupled between the suction arrangement and the blowing arrangement being provided and defining a fluid path between the suction port (1) and the blowing port (5), a spraying device (3) being arranged in the fluid path for driving gas from the suction port to the blowing port and being arranged for spraying a liquid in the fluid path for purifying and/or cooling media flowing through the fluid path. The invention also relates to a method of guiding and processing harmful gases near a doorway.

16 Claims, 3 Drawing Sheets

30
31
33
1
80
3
8
32
5
12

13
14
15
33
34
21
10
1
2a
2b
4
7
9
5
20
12
11
3
6
8
80

BARRIER APPARATUS FOR RESISTING PASSAGE OF HARMFUL GASES THROUGH AN OPENING

BACKGROUND OF THE INVENTION

The invention relates to a barrier apparatus for resisting passage of harmful gases from a space through a substantially vertical opening having a top, a bottom and lateral sides, the barrier apparatus comprising a suction arrangement for sucking gases and blowing arrangement for creating a flow of a medium.

A barrier apparatus as described above is known for example from the International Patent Publication WO 93/10861. This reference discloses spray heads mounted above a doorway and arranged to produce a fog-like curtain of water. The spray heads operate at a high pressure, i.e. over 50 bar, and they produce in their immediate surroundings a high negative pressure that sucks smoke gases into the water spray. When the smoke gases are mixed with the spray, which preferably comprises a huge number of small droplets of water, the particles in the smoke gases are absorbed into the spray, thus mixing with the water droplets and being purified. With this method the harmful effects of poisonous gases have been greatly reduced. Another advantage is that when spray heads are arranged in small spaces, such as ship cabins and hotel rooms, smoke gases can be prevented rather effectively from spreading outside the small spaces, for example to corridors and further to other spaces.

The barrier apparatus disclosed in WO 93/10861 has been found to be especially effective in preventing smoke from spreading from small rooms to other spaces. Due to the operation described above, the barrier apparatus are also used to extinguish a fire. However, the spray means are not particularly applicable for use in large spaces, i.e. when smoke should be effectively absorbed and purified in big spaces.

The invention also relates to a method of guiding and processing harmful gases, especially smoke gases produced in a fire, near a substantially vertical opening, especially a doorway, and in a space comprising the harmful gases, in which method a flow of medium is created in the immediate vicinity of the opening.

WO 93/10861 discloses a method for guiding and purifying smoke gases near a doorway. Smoke gases can be guided and purified effectively when the spray means are located in a rather small space, which is subjected to a fire and should thus be purified of smoke gases. However, if the space that should be purified is large and there is no fire, the purification of smoke gases is not as effective as it should be.

BRIEF DESCRIPTION OF THE INVENTION

An object of the invention is to provide a barrier apparatus and a method enabling effective processing or treating, even in a large space, of harmful gases, such as smoke gases produced in a fire, and other poisonous gases so as to reduce the harmful effects thereof.

For this purpose, the barrier apparatus according to the invention is characterized in that the suction arrangement comprises at least one suction port located near the top of the opening to provide suction substantially along the width of the opening, the blowing arrangement comprises at least one blowing port located near the bottom of the opening to provide blowing substantially along the width of the opening, a fluid coupling coupled between the suction arrangement and the blowing arrangement being provided and defining a fluid path between the suction port and the blowing port, a spraying device being arranged in the fluid path for driving gas from the suction port to the blowing port and being arranged for spraying a liquid in the fluid path for purifying and/or cooling media flowing through the fluid path.

Preferably the suction arrangement comprises a top suction duct located along the top of the opening and comprising said at least one suction port, and a first side suction duct and a second side suction duct located along opposite lateral sides of the at least one opening in the upper region thereof, and each side suction duct comprising at least one side suction port at a level below said at least one suction port. Such a construction makes the apparatus efficient and simple.

According to a preferred embodiment of the invention, the spraying device is arranged to spray liquid in the form of a fog-like spray. The fog-like spray purifies gases, e.g. smoke gases produced in a fire, very efficiently.

Preferably the spraying device is a spray head located in a side suction duct.

Preferred embodiments of the barrier apparatus are described in the appended claims 2 to 9.

The sucking is carried out near the top of an opening, which is very advantageous when applying the present invention for purifying smoke gases produced in a fire. These smoke gases are hot and move therefore upwards and are likely present near the top of the opening.

The method according to the invention is characterized in that in an upper area of the opening in an area substantially corresponding to the width of the opening gases are sucked from the space into at least one suction port, and that near a bottom area of the opening in an area substantially corresponding to the width of the opening purified gases are blown from at least one blowing port into the space, said suction and said blowing being directed so as to at least substantially prevent air from penetrating via the opening into the space.

Preferably the gases are guided above the opening and the medium is sprayed near the very bottom the opening.

Preferably in upper parts of the lateral sides of the opening gases are sucked from the space into further suction ports and from a level below said at least one suction port and above the middle of the lateral sides of the opening.

When applying the method for guiding and purifying smoke gases produced in a fire, preferably a fog-like medium is sprayed with a spraying device at a high pressure to establish a flow path between said at least one suction port and said at least one blowing port and to provide the suction into said at least one suction port and to provide the blowing from said at least one blowing port, smoke gases being guided by said suction into the fog-like medium discharged from the spraying device in order to absorb in smoke gas particles. The fog-like medium is preferably an aqueous medium.

A primary advantage of the invention is that harmful gases can be effectively transformed into a harmless form even if they are produced in a large space. When the invention is applied to extinguishing a fire, an important advantage is that the suction of air via the opening towards the fire is prevented rather efficiently, which greatly contributes to putting out the fire. Oxygen poor purified gases are blown through the blowing port towards the space to be purified.

BRIEF DESCRIPTION OF THE FIGURES

The invention will be described below in greater detail by means of two examples with reference to the accompanying drawing, in which.

DETAILED DESCRIPTION OF THE FIGURES

Figure 1:
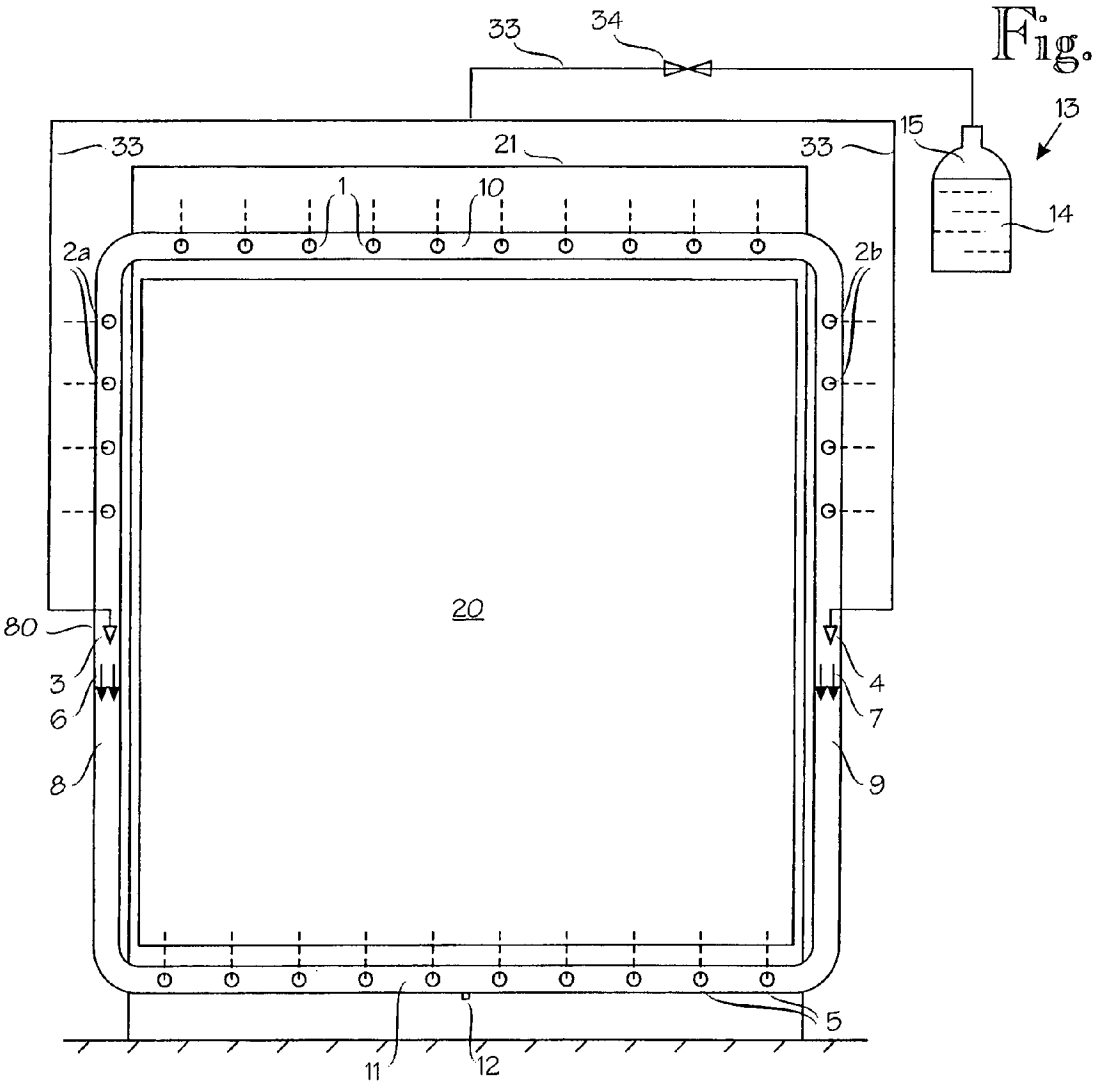
FIG. 1 is a front view of spray means arranged around a doorway.

In FIG. 1, a doorway 20 is surrounded by a rectangular pipe system. The pipe system comprises a top suction duct in the form of a horizontal pipe section 10, a bottom blowing duct in the form of a horizontal pipe section 11, and side suction ducts in the form of vertical pipe sections 8 and 9 connecting the horizontal pipe sections. The aforementioned pipe sections 8 to 11 are provided with such lengths that the rectangle they form is slightly greater than the rectangle formed by the doorway, so that the pipe system in the doorway does not prevent the installation of a door therein, or passage through the doorway. The doorway may, particularly if it is high, also be higher than the pipe sections 8, 9: reference numeral 21 is drawn to such a doorway. The pipe sections 10 and 11 may in some applications be shorter than the width of the doorway. The pipe sections are in flow communication with one another. Pipe section 10 is provided along the length thereof with a number of suction ports in the form of openings 1 facing a room 30 or other space. Correspondingly, pipe section 11 is provided along the length thereof with a number of spray ports in the form of openings 5 facing the room 30. Pipe sections 8 and 9 are provided with side suction ports in the form of openings 2*a* and 2*b*, respectively, facing the room 30. The suction openings 2*a*, 2*b* are formed above the middle of the respective pipe sections 8 and 9 so as to extend substantially to the elbow of the pipe system. The suction openings 1, 2*a*, 2*b* and the spray openings 5 are formed on the walls of the respective pipe sections 10, 8, 9 and 11. These openings 1, 2*a*, 2*b*, 5 are directed for sucking and blowing respectively at an angle of between 20 and 90°, preferably between 40 and 90°.

Inside pipe sections 8 and 9 are provided spray heads 3 and 4, respectively, below the suction openings 2*a* and 2*b*. The spray heads 3, 4 are of a type that is able to operate at a high pressure, typically for example from 50 to 200 bar. In principle the high pressure can be any pressure that is higher than a low pressure, i.e. about 12 bar. In practice a pressure range of from 20 to 300 bar covers the entire required area of pressure.

Figure 2:
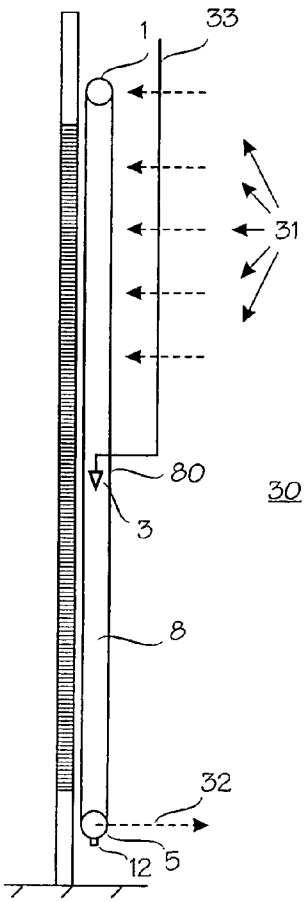
FIG. 2 is a side view of the spray means of FIG. 1.

If the space 30 is to be protected against harmful gases arising from the space on the left side of the doorway in FIG. 2, a pipe system similar to the pipe system on the right side of the doorway should be installed on the left side of the doorway.

Figure 3:
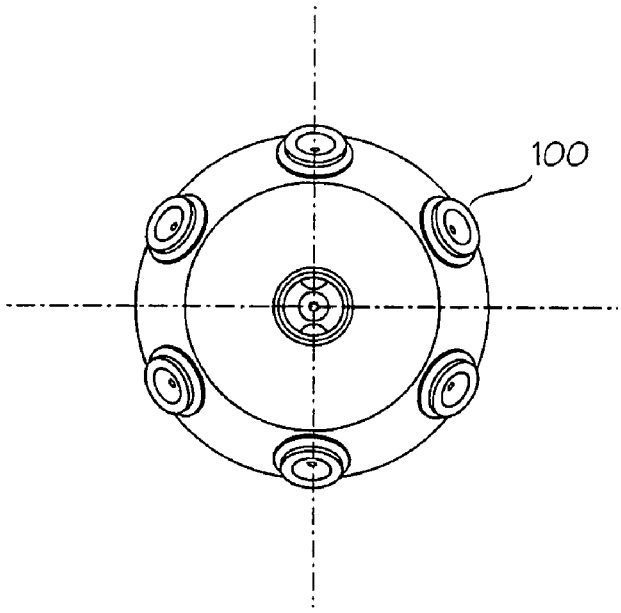
FIG. 3 is an end view of a spray head.
Figure 4:
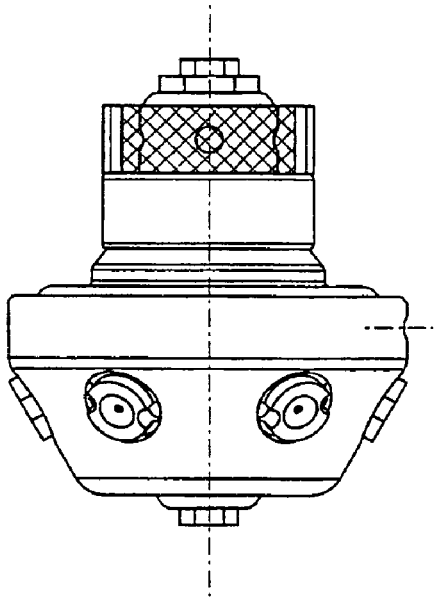
FIG. 4 is a longitudinal view of the spray head according to FIG. 3, and FIGS. 5 and 6 show a second embodiment of the invention.

FIGS. 3 and 4 show a spray head that can be utilized in the present invention. The spray head is provided with a plurality of nozzles 100. When these spray heads operate at a high pressure, they spray a fog-like liquid-containing medium illustrated by reference numerals 6 and 7 along pipe sections 8, 9 and 11 to produce in their immediate vicinity a negative pressure. This negative pressure is apparent from a suction which prevails behind the spray heads, said suction, in turn, producing suction in the suction openings 1, 2*a* and 2*b*. The suction is illustrated in FIG. 2 by reference numeral 31. A spray illustrated by reference numeral 32 in FIG. 2 is directed from the spray openings 5 into the room 30.

The spray heads 3, 4 are connected via a supply line 33 to a hydraulic accumulator 13, which comprises a space 14 for an aqueous liquid and another space 15 for nitrogen gas or some other gas. The space 15 for gas is subjected to a high pressure, which makes the liquid move via the supply line 33 to the spray heads 3, 4, provided that a valve 34 is open. Unlike in the figure, the hydraulic accumulator 13 can comprise separate vessels for gas and liquid. A high pressure pump can be used as an alternative to the hydraulic accumulator.

The pipe sections 8 to 11 are preferably made of steel or plastic, and the diameter thereof varies from 30 to 300 mm, preferably from 50 to 200 mm, whereas the diameters of the openings 1, 2*a*, 2*b*, 5 provided in the pipe sections vary between 2 and 100 mm, preferably between 5 and 50 mm. Suitable dimensions, number of openings, the pressure to be used, and the volume of the hydraulic accumulator 13 are selected separately for each application. The flow resistance in the suction openings 1, 2*a*, 2*b* is preferably selected to correspond to the flow resistance in the spray openings 5.

The operation of the equipment shown in the figures will be described below.

Assume that smoke is produced in the space 30. A smoke detector (not shown in the figures) provided in the space 30 gives a signal, which opens the valve 34 and also ensures directly or indirectly that other possible obstacles preventing the flow of liquid from the hydraulic accumulator 13 to the nozzles of the spray heads 3, 4 are removed. The hydraulic accumulator 13 starts to empty and an aqueous medium moves at a high pressure to the spray heads 3, 4 and further out of the spray heads in a fog-like or gaseous form (cf. arrows 6 and 7). A negative pressure produced in the suction openings 1, 2*a*, 2*b* sucks smoke and other gases into pipe section 10 and into the upper parts of pipe sections 8 and 9. In the lower parts of pipe sections 8 and 9 the smoke is mixed with the fog-like aqueous sprays 6, 7 and is thus purified. The sprays 6, 7 have a droplet size of typically under 400 $\mu$m. Water containing smoke particles is discharged via a drain 12 provided at the lower end of the pipe section 11, so that the pipe section is constantly in working order for blowing oxygen poor purified gases via the spray openings 5.

When the spray means operate as described above, the space 30 is provided with constant circulation where smoke gases are sucked into the pipe system 8–11 and discharged therefrom back into the space in a purified form.

Figure 6:
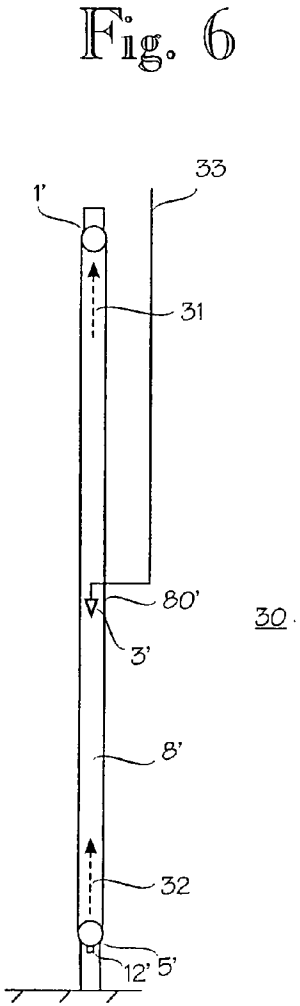
Figure 5:
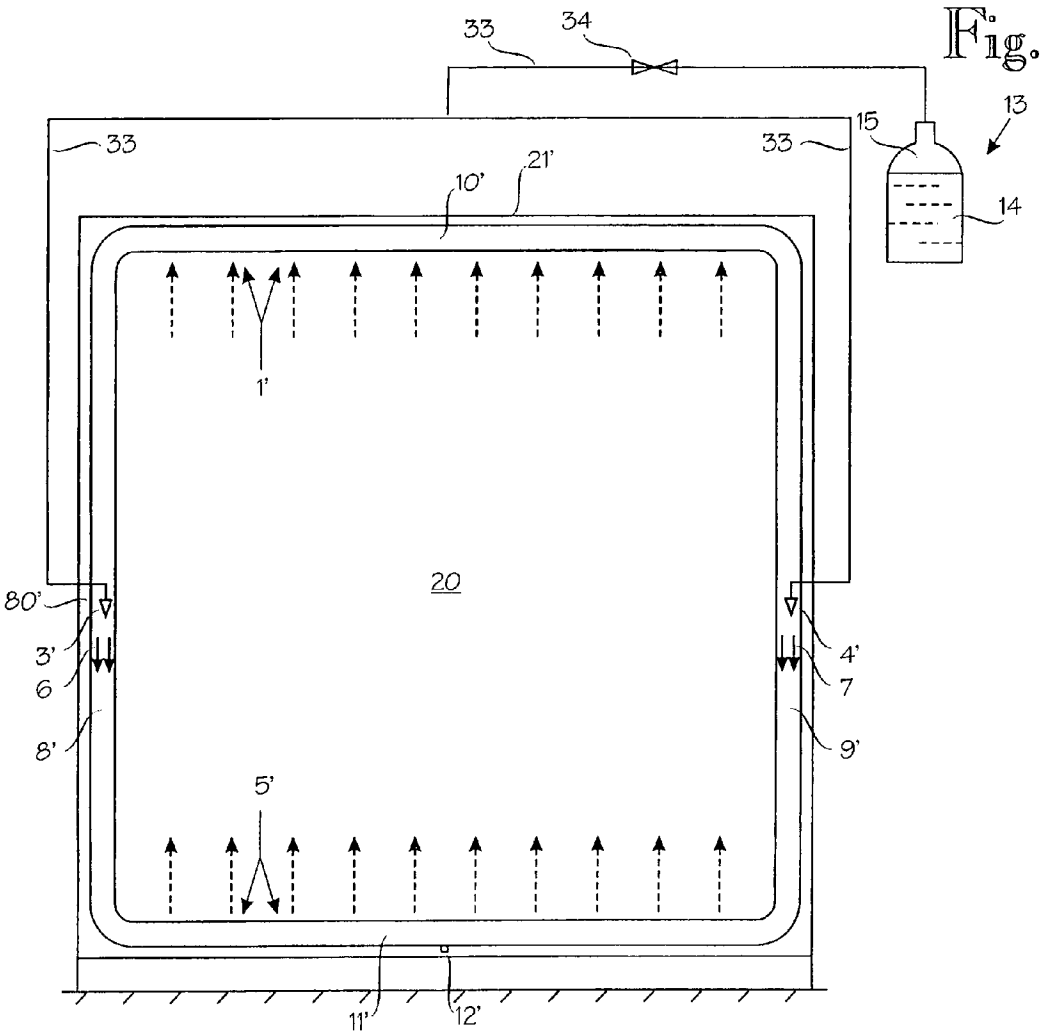

FIGS. 5 and 6 show another embodiment of the present invention. Corresponding reference numerals as in FIGS. 1 and 2 have been used for similar components. The pipe system in FIGS. 5 and 6 is installed in the middle of the doorway having the suction openings 1' and spraying openings 5' facing each other. Such a pipe system protects harmful gases from flowing to either side of the doorway, although not as effectively as two separate pipe systems positioned on respective sides of the doorway.

The invention is described above by means of two examples only, wherefore it is noted that the details of the invention can be implemented in various ways within the scope of the appended claims. Thus, the shape of the pipe system and the medium to be sprayed can differ from what is disclosed above, and the spray means can be used more generally to process and neutralize harmful gases and not necessarily to purify smoke gases produced in a fire. Two vertical pipe sections 8 and 9 and side openings 2*a*, 2*b* are not a necessity although very advantageous. Only one vertical pipe section, even without any side opening, can be contemplated for some applications. Naturally, the number of the suction openings 1, 2*a*, 2*b* and the spray openings 5 can differ from what is described above. Instead of a plurality of suction and spray openings, it is possible to use suction opening means and spray opening means, respectively, that are in the shape of an elongated slot which extend substantially along the width of the doorway. The spray opening and suction opening means do not necessarily comprise a spray head since the spraying and suction can also be provided with other kinds of spraying means. However, a spray head is particularly advantageous in providing the required spraying and suction. The number of the spray heads 3, 4 can differ from what is disclosed above: a single spray head arranged in pipe section 11 is sufficient. However, due to spray heads arranged in pipe sections 8 and 9 the structure of the pipe system can be made very simple and the operation thereof effective. If the doorway 20 is large, i.e. pipe sections 8 and 9 are long, spray nozzles can be arranged in the pipe sections one after another, such that the rear or upper nozzle sprays towards the front or lower nozzle, which sucks in the medium sprayed from the rear or upper nozzle. With this arrangement the flow resistances in the pipe sections, no matter how great, do not form an obstacle for spraying. The geometrical form of the doorway, or other opening through which harmful gases may not pass through, does not have to be a rectangle: it can e.g. be circular. The purification of gases can be done by a filter in addition to or as an alternative to the purification by means of a spraying device such as a spray head.

What is claimed is:

1. A barrier apparatus for resisting passage of harmful gases from a space through a substantially vertical opening having a top, a bottom and lateral sides, the barrier apparatus comprising a suction arrangement for sucking gases and blowing arrangement for creating a flow of a medium, wherein the suction arrangement comprises at least one suction port (1, 1') located near the top of the opening to provide suction substantially along the width of the opening, the blowing arrangement comprises at least one blowing port (5, 5') located near the bottom of the opening to provide blowing substantially along the width of the opening, and a fluid coupling (8, 9, 8', 9') coupled between the suction arrangement and the blowing arrangement being provided and defining a fluid path between the suction port (1, 1') and the blowing port (5, 5'), a spraying device (3, 3') being arranged in the fluid path for driving gas from the suction port to the blowing port and being arranged for spraying a liquid in the fluid path for purifying and/or cooling media flowing through the fluid path.

2. A barrier apparatus as claimed in claim 1, comprising a first side suction port (2*a*) and a second side suction port (2*b*), said ports being located at opposite lateral sides of the opening in an upper region thereof, at a level below said at least one suction port (1).

3. A barrier apparatus as claimed in claim 1, wherein the suction arrangement comprises a top suction duct (10) located along the top of the opening and comprising said at least one suction port (1), and a first side suction duct (8) and a second side suction duct (9) located along opposite lateral sides of the opening in an upper region thereof, and each side suction duct comprising at least one side suction port (2*a*, 2*b*) at a level below said at least one suction port, and a bottom blowing duct (11) located along the bottom of the opening and comprising said at least one blowing port (5).

4. A barrier apparatus as claimed in claim 1, wherein the suction arrangement comprises a top suction duct (10') located along the opening and comprising said at least one suction port (1') and a bottom blowing duct (11') located along the bottom of the opening and comprising said at least one blowing port (5'), said at least one suction port and said at least one blowing port facing each other.

5. A barrier apparatus as claimed in claim 3, wherein the top suction duct (10), the bottom blowing duct (11) and the side suction ducts (8, 9) have a diameter between 30 and 300 mm and the diameters of the suction ports (2*a*, 2*b*) and said at least one blowing port (5) are between 2 and 100 mm.

6. A barrier apparatus as claimed in claim 3, wherein at least the first side suction duct (8) is coupled between the top suction duct (10) and the bottom blowing duct (11) to define the fluid path between said at least one suction port (1) and said at least one blowing port (5), and the spraying device (3) being arranged in the first side suction duct for driving gas from said at least one suction port to said at least one blowing port and wherein no suction ports are provided in an area below a height level midway between the top suction duct and the bottom blowing duct.

7. A barrier apparatus as claimed in claim 1, wherein the spraying device (3, 3') is arranged to spray the liquid in the form of a fog-like spray (6, 7).

8. A barrier apparatus as claimed in claim 3, wherein the top suction duct (10), the side suction ducts (8, 9) and the bottom blowing duct (11) are mounted on a face of a wall through which the opening is formed.

9. A barrier apparatus as claimed in claim 8, wherein said at least one suction port (1) and said at least one blowing port (5) are facing the space.

10. In a method of guiding and processing harmful gases near a substantially vertical opening defined by upper and bottom areas and lateral sides in a space comprising the harmful gases, in which method a flow of medium is created in the immediate vicinity of the opening, the improvements wherein, in the upper area of the opening in an area substantially corresponding to the width of the opening gases are sucked from the space into at least one suction port (1, 1') in upper parts of the lateral sides of the opening gases are sucked from the space into further suction ports (2*a*, 2*b*) and from a level below said at least one suction port (1) and above the middle of the lateral sides of the opening, and near the bottom area of the opening in an area substantially corresponding to the width of the opening purified gases are blown from at least one blowing port (5, 5') into the space, said suction and said blowing being such as to at least substantially prevent air from penetrating via the opening into the space.

11. In a method of guiding and purifying smoke gases produced in a fire, near a substantially vertical opening defined by upper and bottom areas and lateral sides and in a space comprising the smoke gases, in which method a flow of medium is created in the immediate vicinity of the opening, the improvements wherein in the upper area of the opening in an area substantially corresponding to the width of the opening gases are sucked from the space into at least one suction port (1, 1'), and near the bottom area of the opening in an area substantially corresponding to the width of the opening purified gases are blown from at least one blowing port (5, 5') into the space, wherein a fog-like medium is sprayed with a spraying device (3, 4, 3', 4') at a high pressure to establish a flow path between said at least one suction port (1, 1') and said at least one blowing port (5, 5') and to provide a suction into said at least one suction port (1, 1') and to provide the blowing from said at least one blowing port (5, 5'), said suction and said blowing being such as to at least substantially prevent air from penetrating via the opening into the space, and such as to guide the smoke gases by said suction into the fog-like medium discharged from the spraying device in order to absorb in smoke gas particles.

12. A method according to claim 11, wherein the fog-like medium is an aqueous medium.

13. A barrier apparatus as claimed in claim 4, wherein the top suction duct (10'), the bottom blowing duct (11') and the side suction ducts (8', 9') have a diameter between 30 and 300 mm and the diameters of the suction ports (1') and said at least one blowing port (5') are between 2 and 100 mm.

14. A barrier apparatus as claimed in claim 4, wherein the suction arrangement additionally comprises at least one first side suction duct (8') coupled between the top suction duct (10') and the bottom blowing duct (11') to define the fluid path between said at least one suction port (1') and said at least one blowing port (5'), and the spraying device (3') being arranged in the first side suction duct for driving gas from said at least one suction port to said at least one blowing port and wherein no suction ports are provided in an area below a height level midway between the top suction duct and the bottom blowing duct.

15. A method according to claim 10 for guiding and purifying smoke gases produced in a fire, wherein a fog-like medium is sprayed with a spraying device (3, 4) at a high pressure to establish a flow path between said at least one suction port (1) and said at least one blowing port (5) and to provide the suction into said at least one suction port (1) and to provide the blowing from said at least one blowing port (5), smoke gases being guided by said suction into the fog-like medium discharged from the spraying device in order to absorb in smoke gas particles.

16. A method according to claim 15, wherein the fog-like medium is an aqueous medium.

* * * * *